United States Patent [19]

Rath

[11] 4,259,794

[45] Apr. 7, 1981

[54] SNOWPLOW

[75] Inventor: Albert Rath, Kitchener, Canada

[73] Assignee: C.E.P. Industries Ltd., Toronto, Canada

[21] Appl. No.: 71,366

[22] Filed: Aug. 30, 1979

[51] Int. Cl.[3] ..... E01H 5/04

[52] U.S. Cl. ..... 37/42 VL

[58] Field of Search ..... 37/42 R, 42 VL, 41, 37/50, 44, 46; 172/277, 413, 805, 464

[56] References Cited

U.S. PATENT DOCUMENTS 3,793,752 2/1974 Snyder ..... 37/42 R

FOREIGN PATENT DOCUMENTS 653231 12/1962 Canada ..... 37/42 VL
1097463 1/1961 Fed. Rep. of Germany ..... 37/42 VL
1117629 11/1961 Fed. Rep. of Germany ..... 37/42 VL
2437723 3/1975 Fed. Rep. of Germany ..... 37/42 VL
2900904 7/1979 Fed. Rep. of Germany ..... 37/42 VL

*Primary Examiner*—E. H. Eickholt
*Attorney, Agent, or Firm*—Ridout & Maybee

[57] ABSTRACT

In a snowplow having a steel blade and an auxiliary blade of elastomeric material which can be moved pivotally from an inoperative to an operative position, power means are provided for raising and lowering the steel blade between first and second working positions. In the second working position the scraping edge of the steel blade is raised from the ground and the auxiliary blade is pivotally moved into cooperative alignment with it, the blade structure as a whole being tilted forwardly to change the angle of attack of the scraping blade.

10 Claims, 5 Drawing Figures

SNOWPLOW

This invention relates to snowplows, and is particularly concerned with snowplow mechanisms of the type having a forwardly mounted blade structure, the blade structure comprising a main blade portion, usually of steel, and an auxiliary blade portion of elastomeric material which is pivotally connected to the main blade portion for movement about a horizontal axis between an operative position in which it is cooperatively aligned with the main blade portion, and an inoperative position in which it is angularly offset with respect to the main blade portion. In a snowplow blade structure of this type the main blade portion is normally a composite structure comprising a moldboard and steel scraping blade cooperating therewith, the steel scraping blade being movable to an inoperative position when the auxiliary elastomeric blade is brought into ground engaging relation. Usually the blade structure can be tilted between first and second working positions, according to whether the steel blade or the elastomeric blade is operative, so as to vary the angle subtended between the scraping blade and the ground.

It is an object of the present invention to provide an improved snowplow mechanism of this type.

A snowplow mechanism in accordance with the present invention comprises, in combination: a support frame; a forwardly mounted blade structure articulately connected to the support frame for movement between first and second working positions, said blade structure comprising a main blade portion having a horizontal scraping edge and an auxiliary scraping blade of elastomeric material pivotally connected to the main blade portion for movement about a horizontal pivotal axis between an operative position, in which it is juxtaposed with said horizontal scraping edge in cooperative alignment with the main blade portion, and an inoperative position; first power means mounted on the support frame and connected to the main blade portion for moving the blade structure between said first working position, in which the horizontal scraping edge is in ground engaging relation, and said second working position in which the horizontal scraping edge is raised; and second power means connected between said main blade portion and said auxiliary scraping blade, said second power means being operable when the blade structure is in the second working position for moving the auxiliary blade between its operative and inoperative positions.

In a preferred embodiment of the invention the auxiliary scraping blade is moved between its operative and inoperative positions by a pair of hydraulic cylinders mounted on the main blade portion and acting on the auxiliary scraping blade through bell crank mechanisms, the bell crank mechanisms being pivotally connected to the main blade portion and providing the pivotal connections between it and the auxiliary blade.

In order that the invention may be readily understood, one embodiment thereof will now be described, by way of example, with reference to the accompanying drawings.

Figure 1:
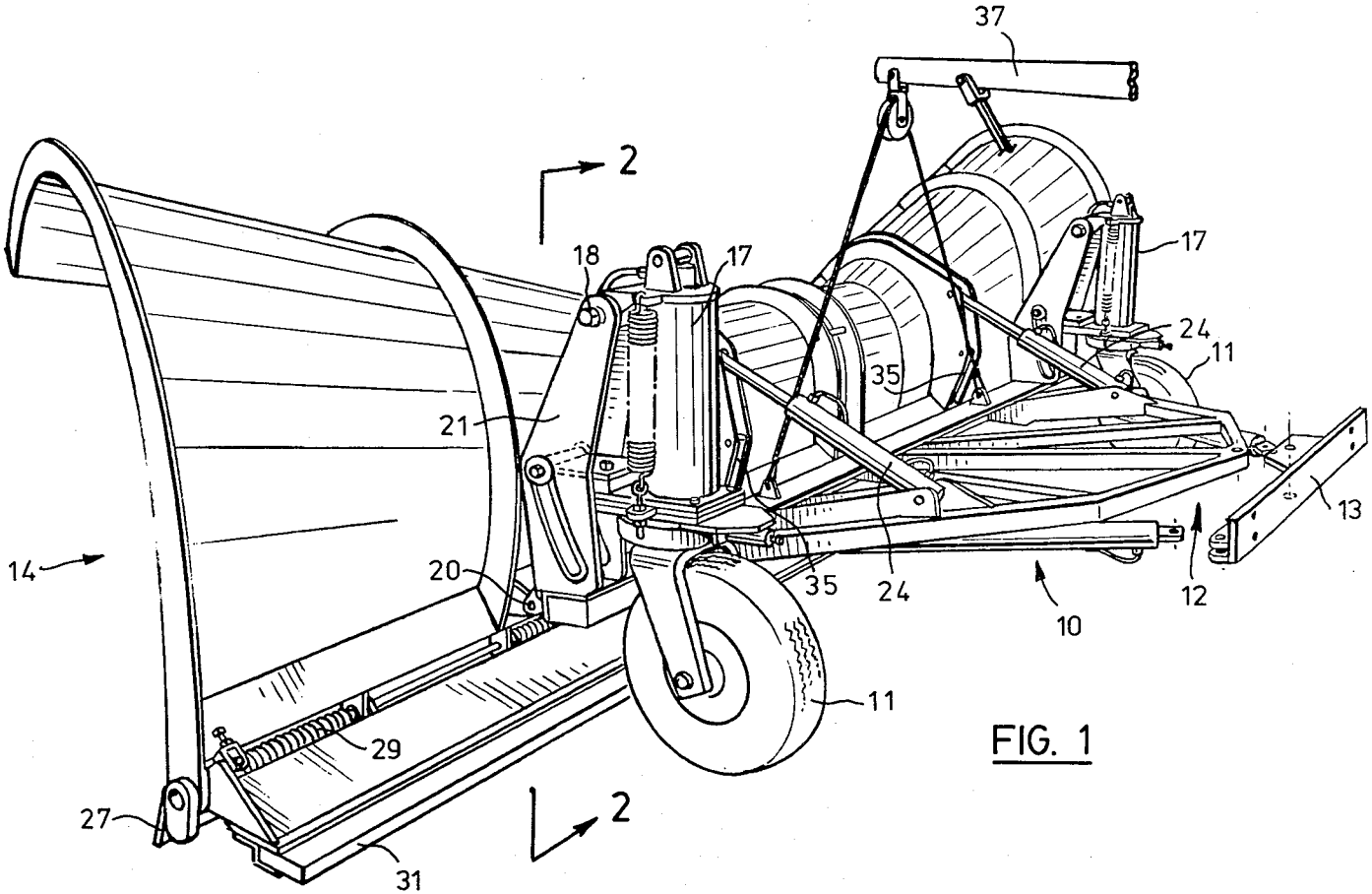
FIG. 1 is a perspective view of the snowplow.

Referring to the drawings, the snowplow comprises a convention support frame 10 mounted on caster wheels 11, the support frame having a three-point hitch 12 for connection to an appropriate forward support 13 of a propelling vehicle. A composite snowplow blade structure 14 is mounted forwardly of the support frame 10, being articulately connected to it by an intermediate support structure 15. The support frame 10 includes a transverse platform 16, on which are mounted a pair of transversely spaced hydraulic cylinders 17, the hydraulic cylinders being vertically mounted and providing horizontal pivotal connections 18 at their upper ends. The intermediate support structure 15 includes a transverse support member in the form of a hollow beam 19, to which the snowplow blade structure 14 is connected by pivotal connections 20; the blade structure 14 is thus capable of pivotal movement about a horizontal axis defined by the connections 20. A pair of plate-like arms 21, which are rigidly connected at their lower ends to the support member 19, are pivotally connected at their upper ends to the cylinders 17 by the pivotal connections 18. Each of the arms 21 is formed with an arcuate guide slot 22 in which a guide member 23 fixedly mounted on the support frame 10 engages; in this way the movements of the intermediate support structure are constrained when it is raised and lowered by the hydraulic cylinders 17.

A pair of transversely spaced hydraulic cylinders 24 mounted on the support frame 10 extend between the support frame and the snowplow blade structure, the forward ends of these cylinders being pivotally connected to the blade structure and the cylinders being operable to tilt the blade structure about the horizontal axis defined by the connections 20. In practice the pairs of hydraulic cylinders 17, 24 are operable in combination to move the blade structure by translational and pivotal movements between first and second working positions as described hereinafter.

Figure 2:
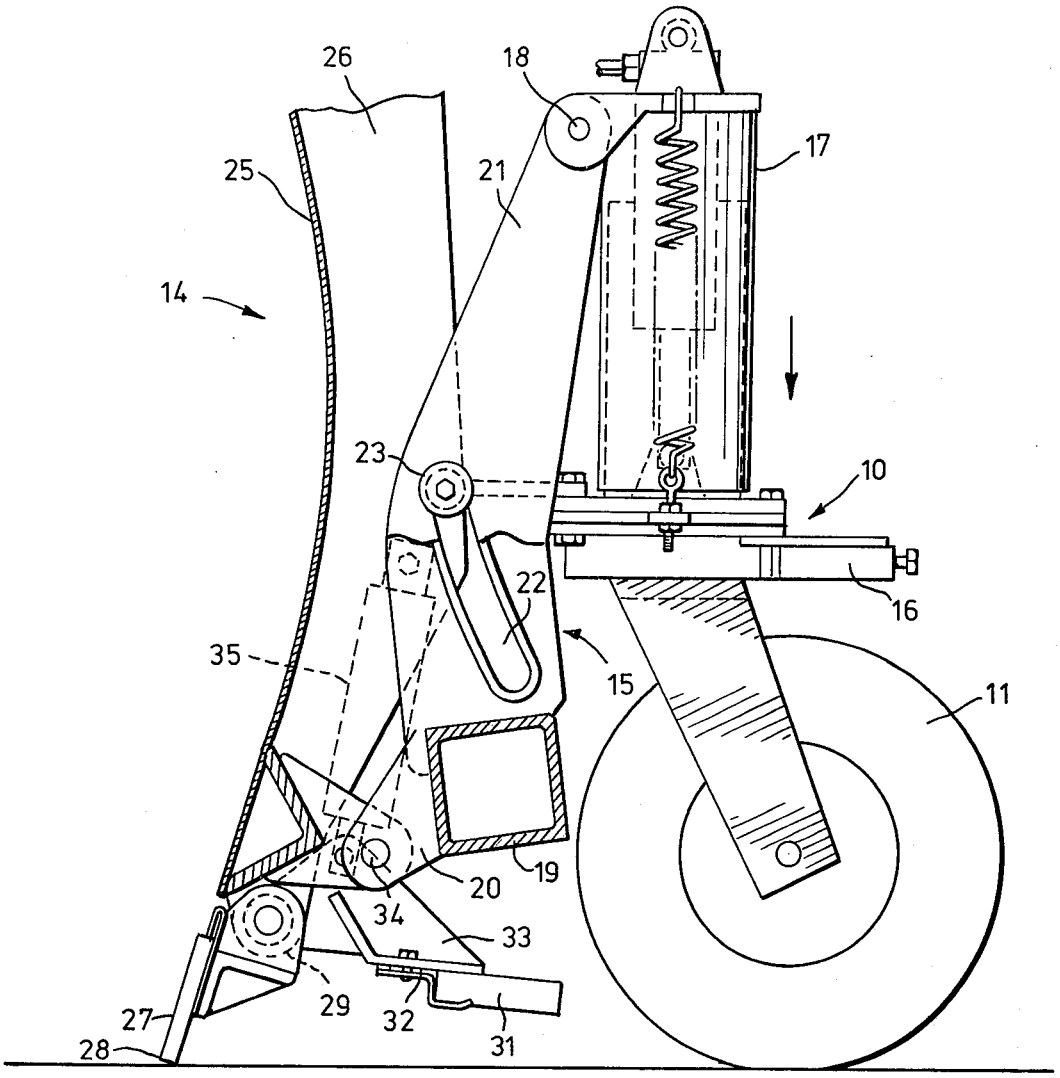
FIG. 2 is a part section taken on line 2-2 in FIG. 1 showing the blade structure in its first working position.
Figure 3:
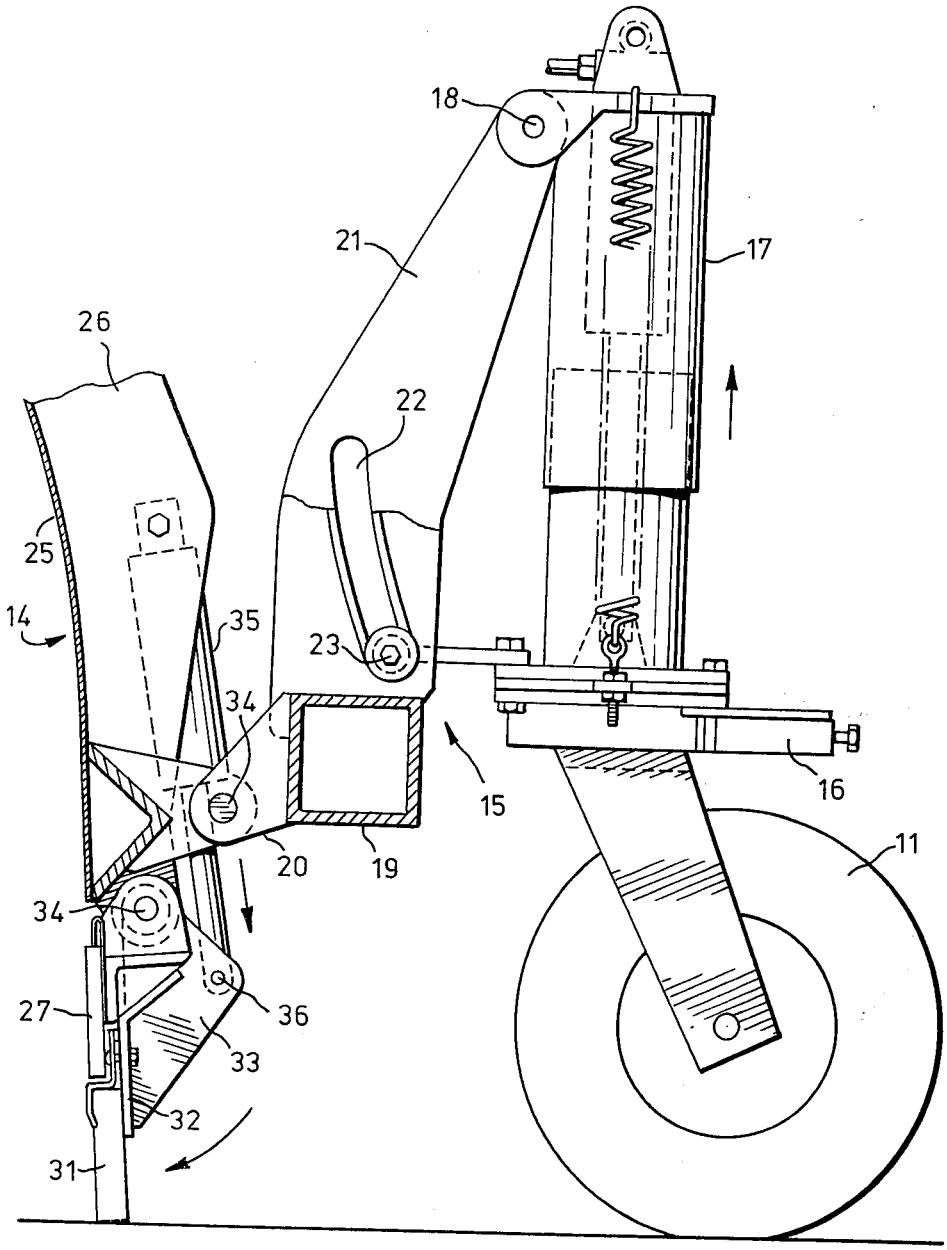
FIG. 3 is a view similar to FIG. 2 but showing the blade structure in its second working position with the auxiliary blade in the operative position.
Figure 5:
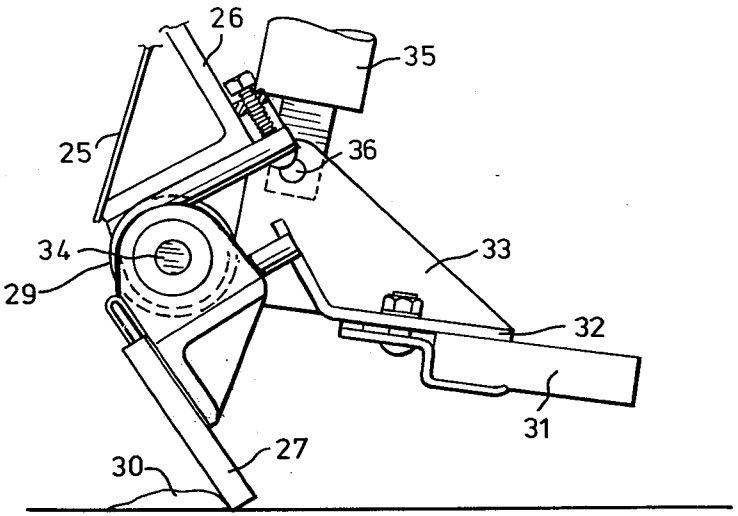
FIGS. 4 and 5 illustrate a detail of the blade structure.
Figure 4:
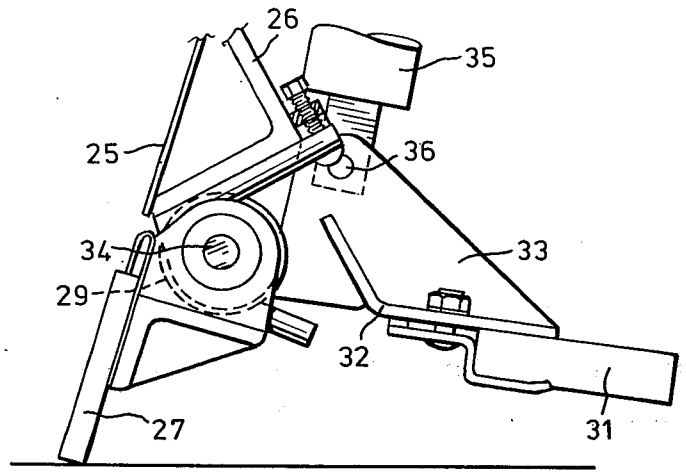

The snowplow blade structure 14 comprises a main blade portion and an auxiliary blade. The main blade portion includes a moldboard 25, which is rigidly mounted on a frame 26, and a steel scraping blade 27 extending along the lower edge of the moldboard. The blade 27 provides a horizontal scraping edge 28 and is pivotally connected to the frame 26 for pivotal movement about a horizontal axis. A torsion spring 29 resiliently biasses the scraping blade 27 towards a normal operative position, as shown in FIG. 4, in which it is cooperatively aligned with the face of the moldboard 25. The blade is displaceable from its normal operative position, however, against the bias of the torsion spring 29, upon encountering a ground obstruction 30 as illustrated in FIG. 5. The blade structure 14 also includes an auxiliary scraping blade 31 of elastomeric material. The auxiliary blade 31 is pivotally connected to the main blade portion for movement about a horizontal pivotal axis between an operative position, shown in FIG. 3, and an inoperative or retracted positin, shown in FIG. 2. In the operative position the auxiliary blade 31 is juxtaposed with the scraping edge 28 of the blade 27 and is arranged in cooperative alignment with the face of the main blade portion constituted by the moldboard 25 and the steel scraping blade 27. In the inoperative position the auxiliary blade 31 is angularly offset with respect to the main blade portion.

The auxiliary blade 31 is mounted on a pair of transversely spaced arms 32 each extending from a bell crank lever 33, which is pivotally connected at its opposite end to the frame 26 by hinge pins 34. The auxiliary blade is thus pivoted about the axis defined by the hinge pins 34, which is coincident with the pivotal axis of the steel blade 27. To move the auxiliary blade 31 between its operative and inoperative positions a pair of transversely spaced hydraulic cylinders 35 are pivotally connected at their upper ends to the frame 26 and are pivotally connected at their lower ends to the apices of the bell crank levers 33, as indicated at 36.

In operation the snowplow is mounted forwardly of the propelling vehicle, the support frame 10 running on the caster wheels 11. When not in use the snowplow can be raised by a boom 37, from the support frame is suspended, so as to clear the ground. FIGS. 1, 2, 4 and 5 illustrate the snowplow in one mode of operation wherein the steel scraping blade 27 is operative, the auxiliary elastomeric blade 31 clearing the ground and being angularly offset with respect to the main blade portion. In this mode of operation the snowplow blade structure is set in its first working position so that the scraping edge 28 of the steel blade 27 engages the ground, the blade structure being tilted rearwardly so that the steel blade makes an obtuse angle with the ground in the direction of travel. As previously mentioned, and as illustrated in FIGS. 4 and 5, the steel blade is displaced upon encountering a ground obstruction, being returned to its normal operating position by the torsion spring 29 when the obstacle is cleared. To convert the snowplow for a second mode of operation wherein the elastomeric blade 31 may be used, the pairs of hydraulic cylinders 17 and 24 are first extended so as to raise the blade structure and so as to tilt the blade structure forwardly about its pivots 20. The blade structure is thus brought to its second working position, and the hydraulic cylinders 35 are extended so as to move the auxiliary blade from its retracted position to its operative position shown in FIG. 3. In this position the auxiliary blade 31 is cooperatively aligned with the main blade portion and makes an acute angle with the ground in the direction of travel.

What I claim is:

1. A snowplow mechanism comprising, in combination:

a support frame;

a forwardly mounted blade structure articulately connected to the support frame for movement between first and second working positions;

said blade structure comprising a main blade portion having a horizontal scraping edge and an auxiliary scraping blade of elastomeric material pivotally connected to the main blade portion for movement about a horizontal pivotal axis between an operative position, in which it is juxtaposed with said horizontal scraping edge in cooperative alignment with the main blade portion, and an inoperative position;

first power means mounted on the support frame and connected to the main blade portion for moving the blade structure between said first working position, in which the horizontal scraping edge is in ground engaging relation, and said second working position in which the horizontal scraping edge is raised; and second power means connected between said main blade portion and said auxiliary scraping blade, said second power means being operable when the blade structure is in the second working position for moving the auxiliary blade between its operative and inoperative positions, said first power means including a first pair of hydraulic cylinders for raising and lowering the blade structure and a second pair of hydraulic cylinders for tilting the blade structure about a horizontal axis between first and second limit positions which are angularly offset with respect to one another.

2. A snowplow mechanism according to claim 1, wherein said second power means comprises a third pair of hydraulic cylinders connected to the auxiliary scraping blade via respective bell crank mechanisms pivotally connected to the main blade portion for pivotal movement about said pivotal axis, the bell crank mechanisms providing the pivotal connection between the auxiliary scraping blade and the main blade portion.

3. A snowplow mechanism according to claim 2, wherein the main blade portion comprises a moldboard rigidly mounted on a frame, the moldboard having a horizontally extending lower edge, and a steel scraping blade extending along said lower edge of the moldboard, the steel scraping blade being pivotally connected to the moldboard frame for pivotal movement about a horizontal axis, the steel scraping blade being resiliently biassed towards a normal position in cooperative alignment with the moldboard and being displaceable therefrom against its bias upon encountering a ground obstruction.

4. A snowplow mechanism according to claim 3, wherein the steel scraping blade is resiliently biassed to its normal position by a horizontally extending torsion bar.

5. A snowplow mechanism comprising, in combination;

a wheeled support frame, an intermediate support structure pivotally connected to the support frame, first power means mounted on the support frame and connected to said intermediate support structure for raising and lowering the intermediate support structure being upper and lower limit positions, a forwardly mounted blade structure pivotally connected to the intermediate support structure for pivotal movement about a horizontal axis, second power means mounted on the support frame and connected to said blade structure for tilting the blade structure about said horizontal axis between first and second limit positions, said first and second power means being operable in combination to move the blade structure between first and second working positions, said blade structure comprising a main blade portion having a horizontal scraping edge which, in said first working position of the blade structure, is in ground engaging relation and, in said second working position, is raised from the ground, said blade structure further comprising an auxiliary scraping blade of elastomeric material pivotally connected to the main blade portion for movement about a horizontal pivotal axis between an operative position in which it is juxtaposed with said horizontal scraping edge in cooperative alignment with the main blade portion and an inoperative position in which it is angularly offset with respect to the main blade portion, and third power means connected between the main blade portion and the auxiliary scraping blade, said third power means being operable when the blade structure is in the second working position for moving the auxiliary blade between its operative and inoperative positions.

6. A snowplow mechanism according to claim 5, wherein the main blade portion comprises a moldboard rigidly mounted on a frame, the moldboard having a horizontally extending lower edge, and a steel scraping blade extending along said lower edge of the moldboard, the steel scraping blade being pivotally connected to the moldboard frame for pivotal movement about a horizontal axis, the steel scraping blade being resiliently biassed towards a normal position in cooperative alignment with the moldboard and being displaceable therefrom against its bias upon encountering a ground obstruction.

7. A snowplow mechanism according to claim 6, wherein said first power means comprises a pair of transversely spaced vertical hydraulic cylinders mounted on the wheeled support frame, the intermediate support structure being connected to the wheeled support frame by pivotal connections provided at the upper ends of said cylinders.

8. A snowplow mechanism according to claim 7, wherein the intermediate support structure comprises a transverse support member to which the blade structure is pivotally connected, and a pair of arms rigidly connected to said support member and connected to the wheeled support frame by said pivotal connections, each arm providing an arcuate guide slot and the support frame providing a pair of fixed guide members engaging in the guide slots to constrain movements of the intermediate support structure as it is raised and lowered by the vertical hydraulic cylinders.

9. A snowplow mechanism according to claim 7, wherein said second power means comprises a second pair of transversely spaced hydraulic cylinders extending between the support frame and the blade structure.

10. A snowplow mechanism according to claim 9, wherein said third power means comprises a third pair of hydraulic cylinders connected to the auxiliary scraping blade via respective bell crank mechanisms pivotally connected to the main blade portion for pivotal movement about said pivotal axis, the bell crank mechanisms providing the pivotal connection between the auxiliary scraping blade and the main blade portion.

* * * * *